US008485850B2

(12) United States Patent
Nesme et al.

(10) Patent No.: US 8,485,850 B2
(45) Date of Patent: Jul. 16, 2013

(54) TELECOMMUNICATIONS CONNECTOR

(75) Inventors: Mathieu Nesme, Sallanches (FR); Guenter M. Zilligen, Grevenbroich (DE); Christian Weinmann, Alsdorf (DE)

(73) Assignee: 3M Innovative Properties Company, St. Paul, MN (US)

( * ) Notice: Subject to any disclaimer, the term of this patent is extended or adjusted under 35 U.S.C. 154(b) by 27 days.

(21) Appl. No.: 13/386,177

(22) PCT Filed: Jul. 27, 2010

(86) PCT No.: PCT/US2010/043413

§ 371 (c)(1),
(2), (4) Date: Jan. 20, 2012

(87) PCT Pub. No.: WO2011/019497

PCT Pub. Date: Feb. 17, 2011

(65) Prior Publication Data

US 2012/0122353 A1 May 17, 2012

(30) Foreign Application Priority Data

Aug. 11, 2009 (GB) ..... 0914025.2

(51) Int. Cl.
*H01R 13/66* (2006.01)

(52) U.S. Cl.
USPC ..... 439/620.11

(58) Field of Classification Search
USPC ..... 439/620.11, 676, 941, 660, 76.11
See application file for complete search history.

(56) References Cited

U.S. PATENT DOCUMENTS

| | | | | |
|---|---|---|---|---|
| 5,199,904 | A | 4/1993 | Wharton | |
| 5,295,869 | A | 3/1994 | Siemon | |
| 5,478,250 | A | 12/1995 | Hoffman | |
| 5,674,093 | A | 10/1997 | Vaden | |
| 5,911,602 | A | 6/1999 | Vaden | |
| 5,915,985 | A | 6/1999 | Fabian et al. | |
| 5,957,720 | A | 9/1999 | Boudin | |
| 5,997,358 | A | 12/1999 | Adriaenssens et al. | |
| 6,086,428 | A | 7/2000 | Pharney et al. | |
| 6,120,330 | A * | 9/2000 | Gwiazdowski | 439/676 |
| 6,186,834 | B1 | 2/2001 | Arnett et al. | |
| 6,196,880 | B1 | 3/2001 | Goodrich | |

(Continued)

FOREIGN PATENT DOCUMENTS

| | | |
|---|---|---|
| CA | 2310064 | 8/1999 |
| DE | 19803075 | 8/1999 |

(Continued)

*Primary Examiner* — Tulsidas C Patel
*Assistant Examiner* — Phuongchi T Nguyen
(74) *Attorney, Agent, or Firm* — Gregg H. Rosenblatt

(57) ABSTRACT

A telecommunications connector (10) comprises an array of contacts (12) connectable to telecommunications wire pairs, the contacts being of a first type or a second type. The first type of contact is shaped so that its contact region (12B) extends in a first direction and the second type of contact is shaped so that its contact region extends in an opposing direction. In an embodiment in the form of an RJ45 jack, to introduce crosstalk compensation, the contacts "3" to "6" in the inner zone of the array are alternately of the first and second types; and the contacts "1", "2" and "7", "8" of each pair in the remainder of the array are respectively of the same type but different from the adjacent contact in the inner zone.

14 Claims, 8 Drawing Sheets

U.S. PATENT DOCUMENTS

| | | | | |
|---|---|---|---|---|
| 6,267,617 | B1 | 7/2001 | Nozick | |
| 6,348,035 | B1 | 2/2002 | Takami | |
| 6,364,712 | B2 | 4/2002 | Dürr | |
| 6,464,541 | B1 | 10/2002 | Hashim et al. | |
| 6,769,937 | B1 * | 8/2004 | Roberts | 439/676 |
| 6,773,302 | B2 | 8/2004 | Gutierrez | |
| 7,035,112 | B2 | 4/2006 | Chen | |
| 7,074,092 | B1 * | 7/2006 | Green et al. | 439/676 |
| 7,112,086 | B1 | 9/2006 | Wu | |
| 7,153,168 | B2 | 12/2006 | Caveney et al. | |
| 7,182,649 | B2 | 2/2007 | Caveney et al. | |
| 7,309,261 | B2 | 12/2007 | Caveney et al. | |
| 7,384,315 | B2 | 6/2008 | Caveney et al. | |
| 7,413,464 | B1 | 8/2008 | Chen | |
| 7,442,092 | B2 | 10/2008 | Caveney et al. | |
| 7,481,681 | B2 | 1/2009 | Caveney et al. | |
| 7,520,784 | B2 | 4/2009 | Caveney et al. | |
| 7,572,133 | B2 | 8/2009 | Hughes et al. | |
| 7,591,689 | B2 | 9/2009 | Caveney et al. | |
| 7,637,780 | B2 | 12/2009 | Schoene et al. | |
| 7,641,610 | B2 | 1/2010 | Nakamura et al. | |
| 7,686,649 | B2 | 3/2010 | Pepe et al. | |
| 7,726,018 | B2 | 6/2010 | Caveney et al. | |
| 7,837,513 | B2 | 11/2010 | Millette | |
| 2002/0132532 | A1 | 9/2002 | Henneberger | |
| 2004/0229517 | A1 | 11/2004 | Bush et al. | |
| 2006/0094281 | A1 | 5/2006 | Dang | |
| 2006/0110983 | A1 | 5/2006 | Muench et al. | |
| 2006/0121790 | A1 | 6/2006 | Hashim | |
| 2007/0270043 | A1 | 11/2007 | Pepe | |
| 2008/0090468 | A1 | 4/2008 | Reeves | |
| 2008/0176453 | A1 | 7/2008 | Minich et al. | |
| 2008/0293305 | A1 | 11/2008 | Quenneville | |
| 2010/0015844 | A1 | 1/2010 | De Dios Martin et al. | |
| 2010/0087100 | A1 | 4/2010 | De Blieck et al. | |
| 2010/0144209 | A1 * | 6/2010 | Hetzer et al. | 439/676 |
| 2011/0300739 | A1 | 12/2011 | Ciezak et al. | |
| 2012/0309238 | A1 * | 12/2012 | Huang et al. | 439/676 |

FOREIGN PATENT DOCUMENTS

| | | | |
|---|---|---|---|
| DE | 100 57 869 | C1 | 8/2002 |
| DE | 10 2006 046180 | | 4/2008 |
| EP | 0 233 397 | A1 | 8/1987 |
| EP | 0 935 314 | A2 | 8/1999 |
| EP | 1 311 022 | A1 | 5/2003 |
| EP | 0 921 603 | B1 | 2/2007 |
| JP | 10-241811 | A | 9/1998 |
| WO | WO 2005-064755 | | 7/2005 |
| WO | WO 2007-021684 | | 2/2007 |

* cited by examiner

TELECOMMUNICATIONS CONNECTOR

CROSS REFERENCE TO RELATED APPLICATIONS

This application is a national stage filing under 35 U.S.C. 371 of PCT/US2010/043413, filed Jul. 27, 2010, which claims priority to Great Britain Application No. 0914025.2, filed Aug. 11, 2009, the disclosure of which is incorporated by reference in its entirety herein.

The present invention relates to connectors for use in telecommunications systems and, more especially, to connector sockets (also known as jacks) of the type used for receiving a mating plug that terminates an input cable containing, for example, telephone or computer data lines.

BACKGROUND

One form of connector that is widely used in the field of telecommunications is the RJ45 type of connector comprising a modular jack for receiving a compatible modular plug that terminates four twisted wire pairs. These connectors are used both in active telecommunications equipment, for example routers, and passive equipment, for example patch panels.

An RJ45 jack has an array of eight contacts at its front side, conventionally numbered 1 to 8, for engagement with respective contacts in the plug. As is well-known, contacts 4 and 5 of the jack are conventionally for connection to a first wire pair on the jack side, contacts 1 and 2 are for connection to a second wire pair, contacts 3 and 6 are for connection to a third wire pair, and contacts 7 and 8 are for connection to a fourth wire pair. In other words, in this type of connector, there is conventionally a region in the array of contacts in which adjacent contacts (i.e. contacts 3 to 6) belong alternately to different wire pairs while, in the remainder of the array, each pair of adjacent contacts (i.e. contacts 1, 2 and 7, 8) belongs to one respective wire pair.

It is known that unwanted crosstalk is mainly created by the plug and front contacts of the jack, especially between the inner wire pairs connected to contacts 3 to 6 of the jack. The amount of crosstalk increases with increasing operating frequency and as the number of connectors occupying a particular space is increased. It may even reach a level at which it interferes with, or prevents, the transmission of data.

The jack of a telecommunications connector conventionally includes a printed circuit board (PCB) on which the connectors may be mounted and through which they are connected to the incoming wire pairs, and it has previously been proposed to implement crosstalk compensation on this PCB (see, for example, WO 2005/064755 (Panduit Corp.); US 2008/0090468 (Reeves et al); and U.S. Pat. No. 6,464,541 (Hashim et al)).

It has also previously been proposed to reduce crosstalk introduced by the mechanical parts of a telecommunications connector by modifying the shape of the front contacts of the jack. This can, however, result in front contacts that have an undesirably complicated shape, or are difficult to assemble and maintain in the required position within the jack, or do not accept and engage consistently with the variety of mating plugs available on the market.

US 2002/0132532 (Henneberger) describes a modular jack of the RJ45 type in which the front contacts have three different geometric configurations, two of the configurations being described as "rearwardly extending" and one of the configurations being described as "forwardly extending". The described configurations are said to assist in reducing crosstalk between the contacts located at positions 3 to 6 of the jack. In another configuration, described in U.S. Pat. No. 6,120,330 (Gwiazdowski), the jack contacts are crossed for the purpose of crosstalk compensation.

It is also desirable, in a telecommunications connector, to have an effective and consistent contact force between the contacts of the jack and those of any mating plug inserted into the jack, across the variety of plugs that is typically available on the market.

SUMMARY

In a first aspect, the present invention is concerned with the problem of enabling the crosstalk introduced by the mechanical parts of a telecommunications connector to be reduced. In a second aspect, the invention is concerned with the problem of providing a telecommunications connector in which the contacts are enabled to engage effectively and consistently with the contacts of a mating telecommunications connector.

In a first aspect, the present invention provides a telecommunications connector comprising an array of contacts connectable to telecommunications wire pairs such that, in a first zone of the array, adjacent contacts belong alternately to different wire pairs and, in the remainder of the array, each pair of adjacent contacts belongs to one respective wire pair; in which the contacts of the array are of a first type or a second type, each type comprising a support region by which the contact is mounted in the connector and a contact region positioned to make electrical connection with a respective contact of a mating telecommunications connector; wherein, to introduce crosstalk compensation:

(i) the first type of contact is shaped so that its contact region extends in a first direction and the second type of contact is shaped so that its contact region extends in an opposing direction;

(ii) adjacent contacts of the first zone of the array are alternately of the first and second types; and (iii) and the contacts of each pair in the remainder of the array are respectively of the same type but different from any adjacent contact of the said first zone of the array.

In a telecommunications connector in accordance with this aspect of the invention, the configuration of the contacts in the first zone of the array (specifically the alternating arrangement of the contact types in this zone) can contribute to a reduction in the crosstalk between the wire pairs associated with those contacts while the configuration of the contacts in the remainder of the array can enable that reduction to be achieved without bringing about an increase in the crosstalk between those wire pairs and the other wire pairs incoming to the connector.

In the particular case in which the connector is an RJ45 jack the first zone comprises the four contacts conventionally numbered "3" to "6".

In an embodiment of the invention, the contact region of the first type of contact extends generally in the same direction as the support region of the contact (specifically, towards the direction from which a mating connector is introduced), and the contact region of the second type of contact extends generally in the opposite direction to the support region of the contact.

The general shaping of the contacts, in particular the location of any bends in the contacts, is selected to ensure that all contacts will be engaged by a mating connector at substantially adjacent locations in their contact regions. At least one of the contacts may be engaged by the mating connector at the apex of a bend in the contact.

Some of the contacts may be shaped so that engagement of the contact region by a respective electrical contact of the mating telecommunications connector moves the free end of the contact, remote from the support region, into engagement with a stop to enhance the electrical connection between the telecommunications connectors.

In a second aspect, the present invention provides a telecommunications connector comprising an array of electrical contacts connectable to telecommunications wire pairs, each contact comprising a support region at one end by which the contact is mounted in the connector, the other end of the contact being free, and a contact region positioned to be engaged by a respective electrical contact of a mating telecommunications connector; wherein:

(i) the support region and the contact region extend generally towards the direction from which the mating connector is introduced; and (ii) the contact region is joined to the support region by an intermediate portion that extends in a direction generally perpendicular to the direction of extent of the support and contact regions;

the contact being so shaped that engagement of the contact region by a respective electrical contact of the mating telecommunications connector moves the free end of the contact into engagement with a stop to enhance the electrical connection between the telecommunications connectors.

In a telecommunications connector in accordance with this aspect of the invention, the configuration of the contacts enables the provision of a connector with mechanical characteristics that ensure effective and consistent engagement with a mating telecommunications connector.

The stop for the free end of a contact may be provided by the housing of the connector.

In both aspects of the invention, at least one of the contacts may have a deflection in the support region to facilitate the close spacing of the connectors. If, for example, the support regions of the contacts are located in a printed circuit board, they may by means of these deflections in the support regions be located in the board in more than one row.

In both aspects of the invention, the connector in which the array of contacts is comprised may be a telecommunications jack. The support regions of the contacts may be located in a printed circuit board and connected, through electrically conductive traces on the board, to respective insulation displacement contacts adapted to be connected to respective wires of an incoming cable. The wires of the incoming cable may be guided to the insulation displacement contacts through a wire guide insertable into the jack. The jack may comprise at least one housing part, for example a pivotal flap, movable into an open position to permit the insertion of the wire guide into the jack and operable when closed to maintain the connection between the wires of the incoming cable and the insulation displacement contacts within the jack.

BRIEF DESCRIPTION OF THE DRAWINGS

By way of example only, connector jacks in accordance with the invention will be described with reference to the accompanying drawings, in which.

DETAILED DESCRIPTION

Figure 1A:
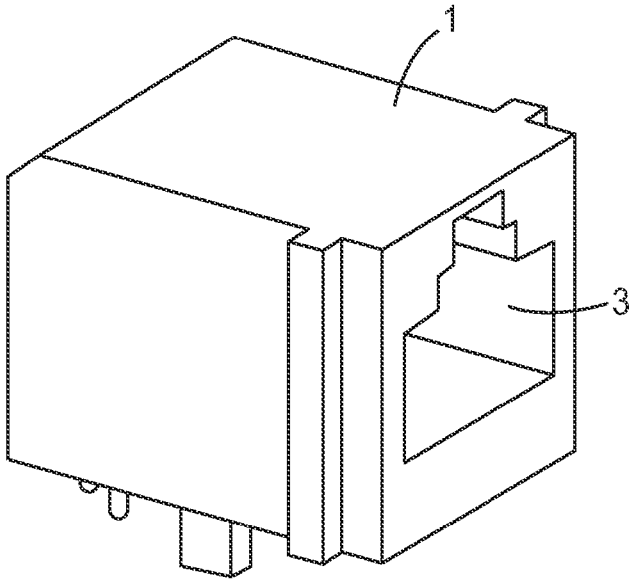
FIGS. 1A and 1B are general perspective views of, respectively, a jack and a plug of a telecommunications connector.
Figure 1B:
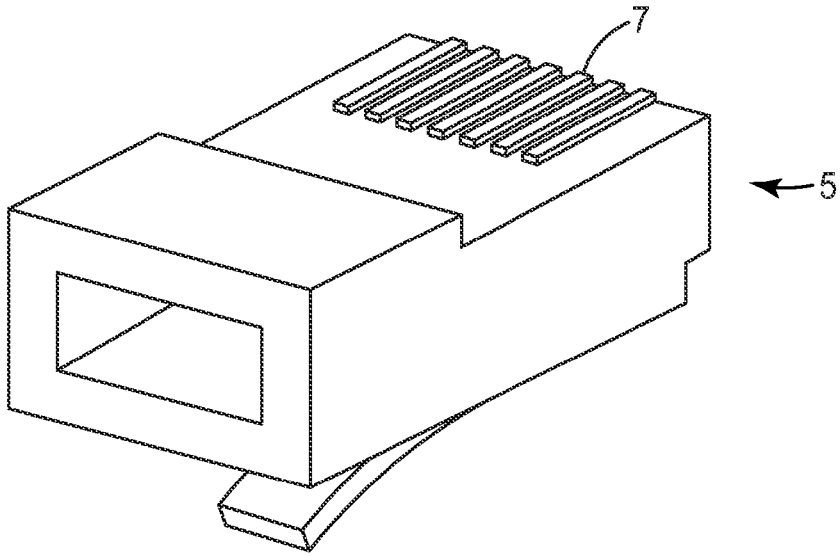

The connector shown in FIGS. 1A and 1B comprises a jack 1 having a front opening 3 for the reception of a mating plug 5. In use, the plug 5 terminates an input cable containing, for example, telephone or computer data lines, and the jack 1 terminates twisted wire pairs to which those telephone/computer data lines are to be connected. The plug 5 has electrical contacts 7 which, when the plug is inserted into the jack 1, engage with front contacts (not visible) within the front opening 3 of the jack.

Figure 2:
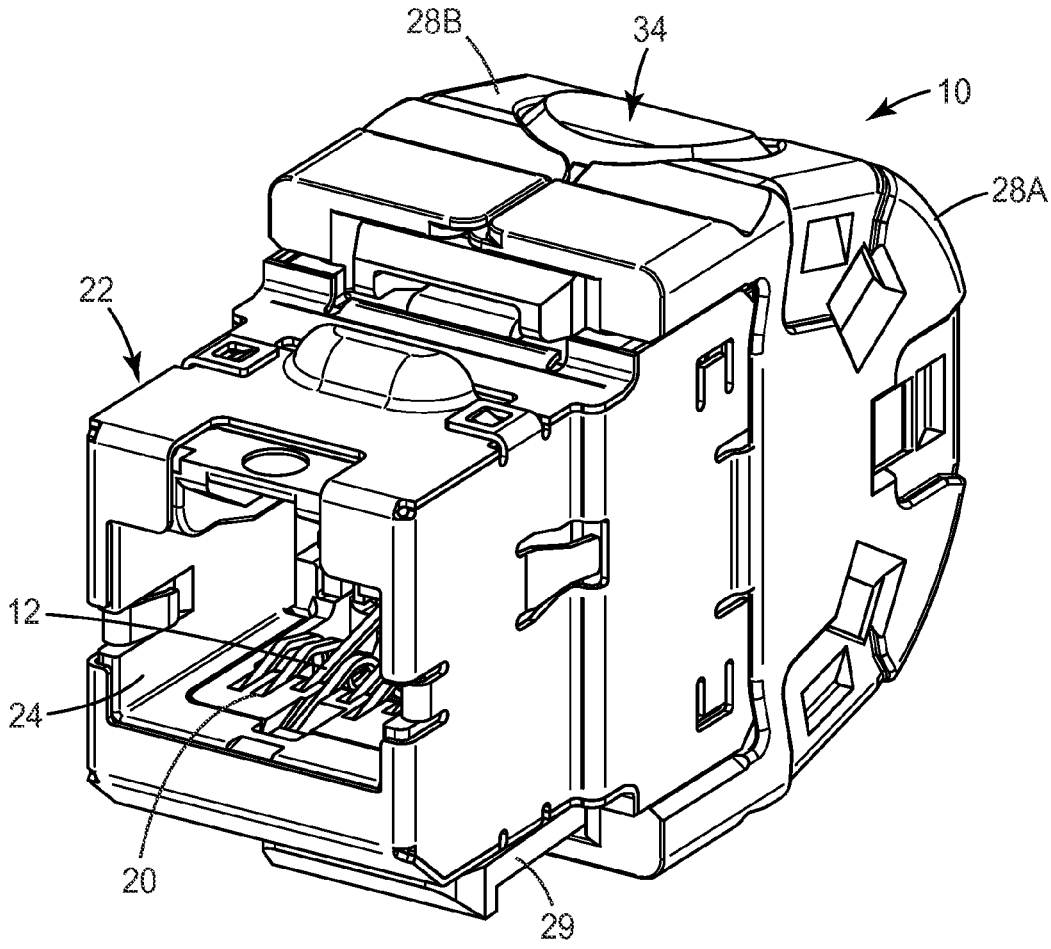
FIG. 2 is perspective view of an RJ45-type jack.
Figure 3:
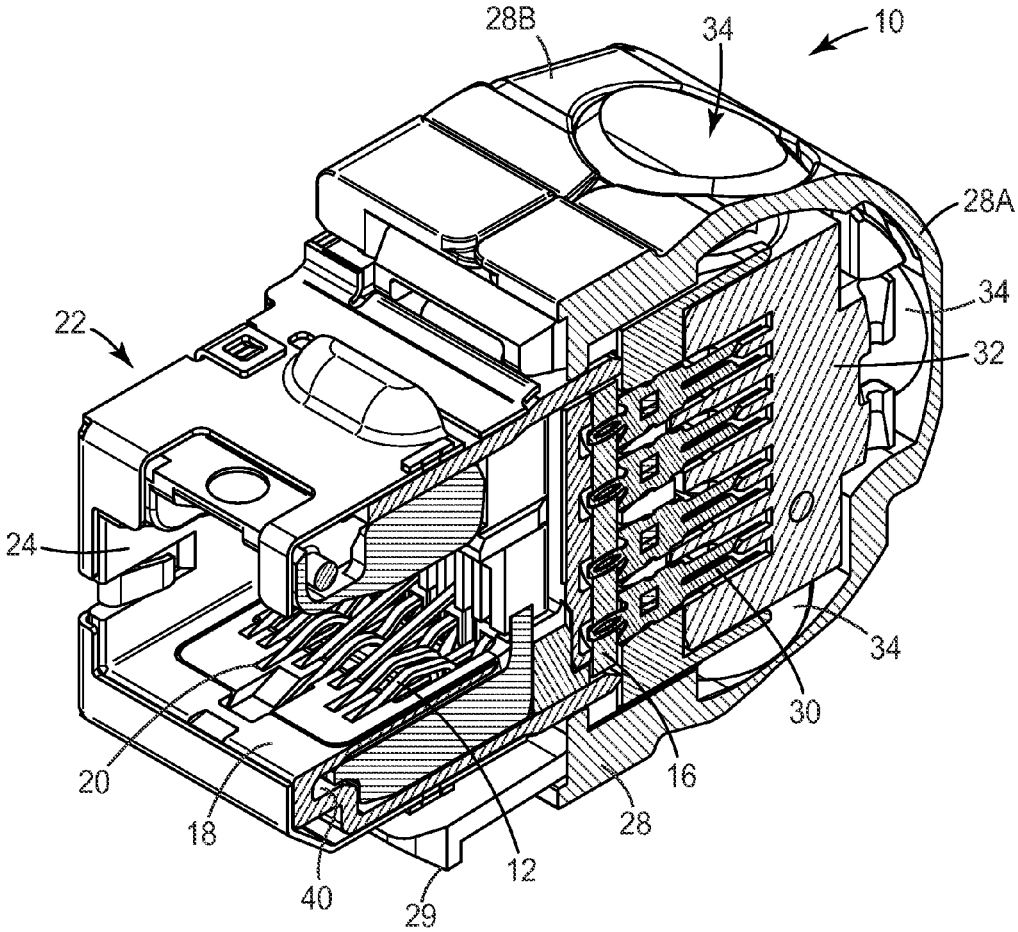
FIG. 3 is a similar view of the jack, with one side broken away.
Figure 4:
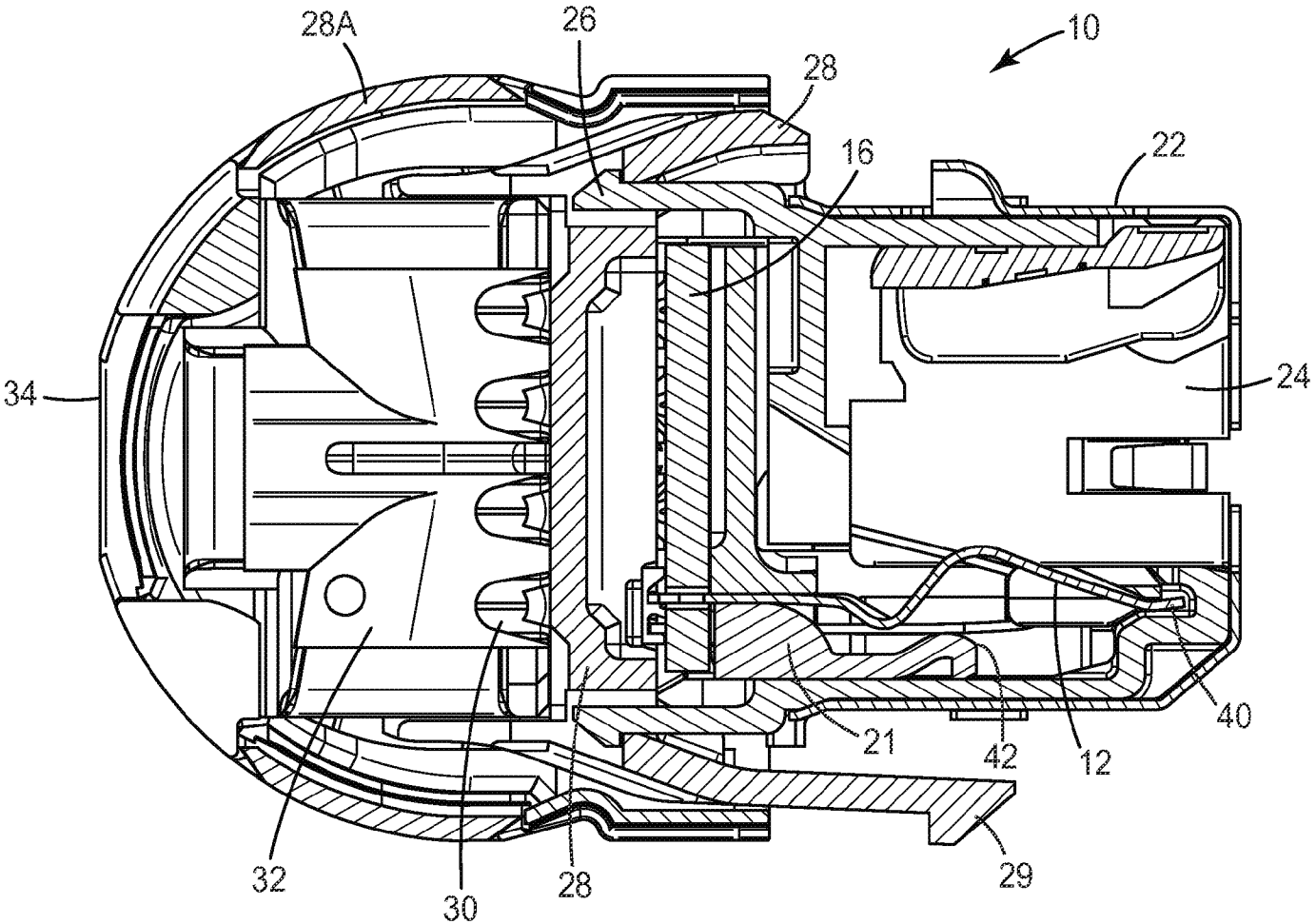
FIG. 4 shows a cross-section of the jack on a central vertical plane.

FIG. 2 shows a jack 10 of the well-known RJ45 type and FIGS. 3 and 4 show the same jack, respectively, with one side removed and in cross-section on a central plane. An RJ45 jack has eight front contacts 12, for connection to four twisted wire pairs in a cable (not shown) incoming to the jack. As described in greater detail below, the front contacts 12 are flexible spring contacts which, when a mating plug is inserted into the jack, resiliently-engage the plug contacts to provide an electrical connection between the two parts of the connector.

Figure 5:
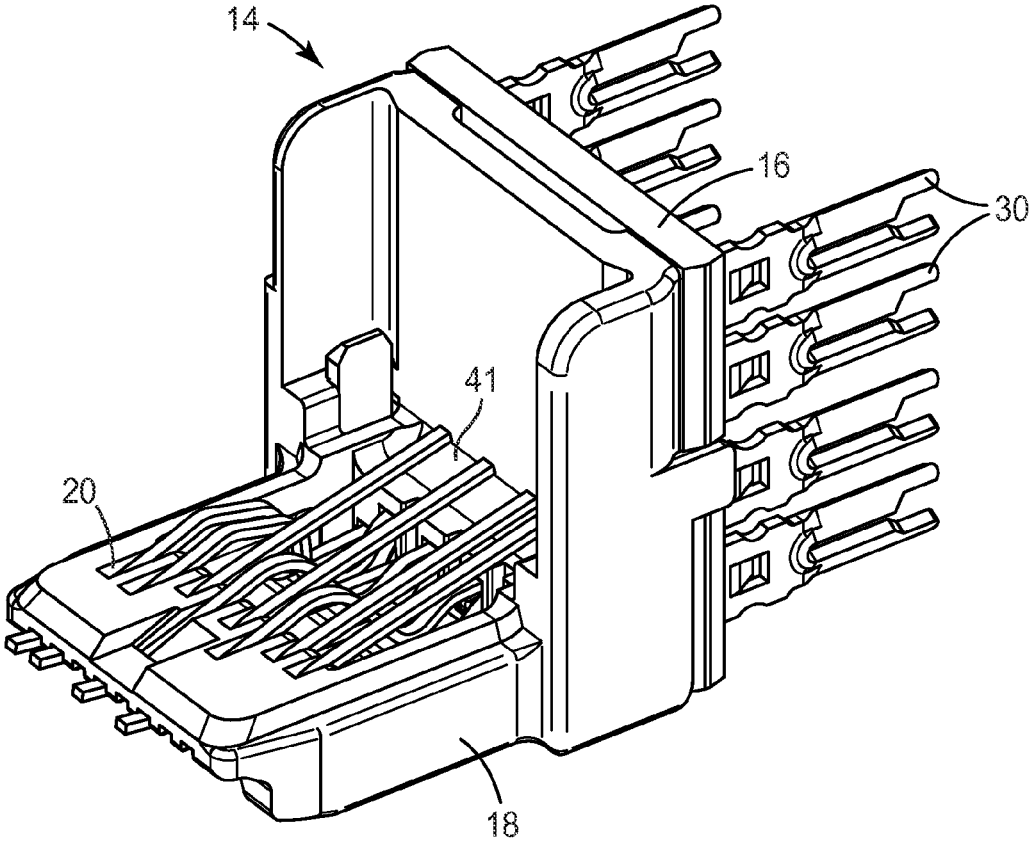
FIG. 5 is a perspective view of the contact support and contacts of the jack.
Figure 6:
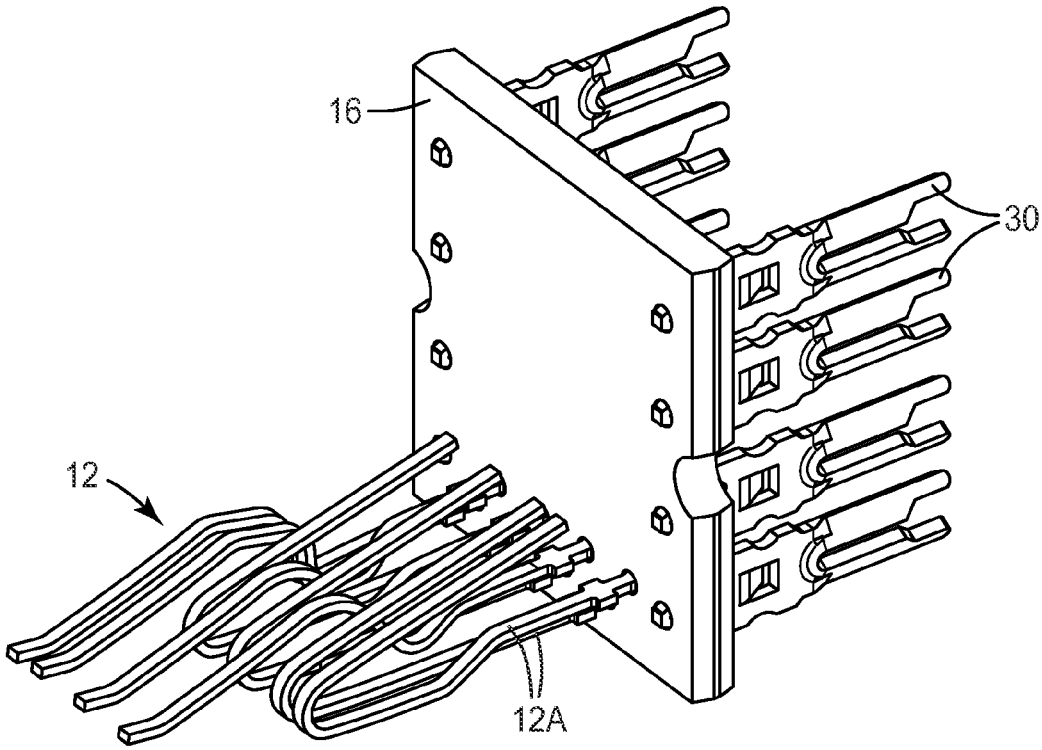
FIG. 6 is similar to FIG. 5, but with part of the contact support removed.
Figure 7:
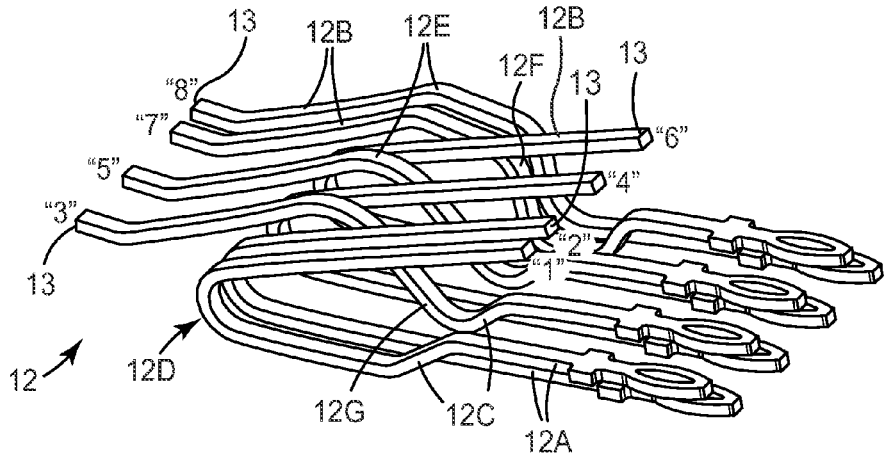
FIG. 7 is a perspective view of the front contacts as they are arranged in the jack.

The front contacts 12 are shown in FIG. 7 separated from the jack 10, so that the shape and arrangement of the contacts (which will be described below) can be seen more clearly. Within the jack 10, the contacts are mounted in a support 14 (FIG. 5). The contact support 14 includes a printed circuit board (PCB) 16, in which one end of each of the front contacts 12 is located as shown in FIG. 6, and a base 18 arranged at 900 to the PCB and provided with guide slots 20 in which parts of the front contacts are positioned. The contact support 14, with the front contacts 12, is contained within a front part 22 of the housing of the jack 10. The front face of the housing part 22 has the above-mentioned opening (here indicated by the reference 24) for the reception, within the housing part 22, of an RJ45-type plug. The front contacts 12 of the jack 10 are secured in place within the jack by a locking member 21 (FIG. 4) which also provides mechanical support for some of the contacts as they are engaged by a plug inserted into the opening 24, as described in greater detail below.

The front housing part 22 of the jack 10 is provided with latch hooks 26 (visible in FIG. 4) by which it can engage, and be connected into, a rear housing part 28. The rear housing part 28 is provided with outwardly-pivotal flaps 28A, 28B (shown in the closed position in FIGS. 2 to 4) that provide access from the rear to the interior of the jack, and with a forwardly-extending hook 29 for mounting the jack in a required location such as on a patch panel. The rear housing part 28 of the jack 10 contains eight insulation displacement contacts (IDCs) 30 located in appropriately-positioned holes in the PCB 16 as shown most clearly in FIGS. 3 and 6. The rear housing part 28 is engaged by a wire guide 32, inserted into the jack 10 when the flaps 28A, 28B are open, through which wire pairs from an incoming cable (not shown) are directed to the IDCs 30. The wire guide 32 is retained in the jack 10 in close contact with the rear housing part 28, with the incoming wires connected to their respective IDCs, by closing the flaps 28A, 28B. Three access ports 34 in the flaps 28A, 28B provide alternative entries for the incoming cable into the jack 10.

The PCB 16 carries printed electrical traces (not shown) that connect each of the IDCs 30 to a respective one of the front contacts 12. The front contacts 12 are conventionally numbered "1" to "8" as indicated in FIG. 7 and, as is well-known, the contacts "4" and "5" in an inner zone of the array are conventionally connected in the rear housing part 28 to a first wire pair; the contacts "1" and "2" at one end of the array are connected to a second wire pair; the contacts "3" and "6" in the inner zone, on each side of the inner contacts, are connected to a third wire pair; and the contacts "7" and "8" at the other end of the array are connected to a fourth wire pair. It is also well known that, when the jack 10 is in use, unwanted crosstalk can occur between the wire pairs connected to the contacts "1" to "8" (especially the wire pairs connected to the inner contacts "3" to "6"), particularly when the contacts are all similarly-shaped or have comparatively-long regions that run parallel to one another, and are closely spaced.

Figure 8:
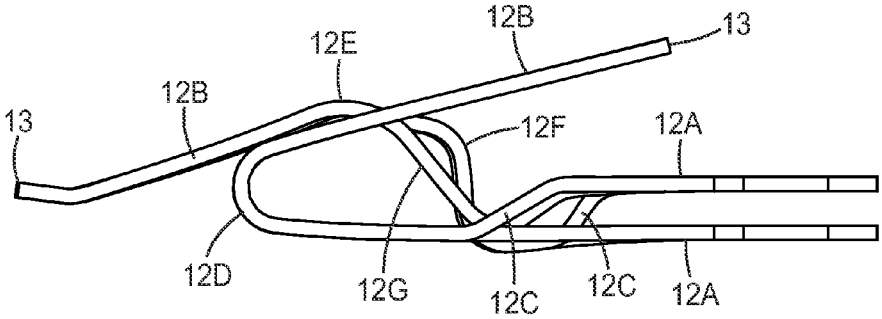
FIG. 8 is a side view of the front contacts of FIG. 7.

In the jack shown in FIGS. 2 to 4, the front contacts 12 are shaped to reduce such unwanted crosstalk. As best shown in FIGS. 7 and 8, each of the contacts 12 comprises a support region 12A adjacent the end of the contact that is mounted in the support 14 of the jack 10, and a contact region 12B adjacent the other (free) end 13 of the contact, the contact region 12B comprising at least that part of the contact 12 that is engaged by the respective contact of a mating plug inserted into the jack 10. As shown in FIG. 6, the support regions 12A of all of the contacts extend perpendicularly from the PCB. Thereafter, the contacts 12 are of either a first type or a second type: contacts "3", "5", "7" and "8" are of the first type, and contacts "1", "2", "4" and "6" are of the second type. The first type of contact is shaped so that its contact region 12B extends generally in the same direction as its support region 12A (i.e. towards the front of the jack 10), and the second type of contact is shaped so that its contact region 12B extends generally in the opposite direction to its support region 12A (i.e. away from the front of the jack). Within those two types of contact, some variations in shape are possible as described below.

It can be seen from FIG. 7 and the above description that the contacts "3" to "6" in the inner zone of the array of front contacts 12 are alternately of the first and second type. It can also be seen that the contacts "1", "2" and "7", "8" of each pair in the remainder of the array are respectively of the same type but different from the adjacent contact in the inner zone (i.e. contact "2" is the same as contact "1" but of the opposite type to contact "3", and contact "7" is the same as contact "8" but of the opposite type to contact "6"). It has been found that such an arrangement of the two types of contacts can contribute to a substantial reduction in the crosstalk between all of the wire pairs connected to the jack 10. More particularly, the alternating arrangement of the contacts "3" to "6" in the inner zone of the array contributes to a reduction in the crosstalk between the first and third wire pairs, while the shape of the contacts in the remainder of the array ensures that this reduction is achieved without bringing about an increase in the crosstalk between those pairs ("1", "2" and "7", "8") and the second and fourth pairs.

It will be appreciated that an arrangement of the type shown in FIGS. 7 and 8, but in which the two types of front contacts are interchanged, could also be employed with similar results.

Provided the general arrangement of the two types of front contacts is maintained, the actual shape of the contacts can be varied if required, for example to bring about a further reduction in crosstalk and/or to accommodate physical constraints imposed by the layout of the contacts themselves and/or to impart certain mechanical properties to some of the contacts.

In the particular arrangement shown in FIGS. 7 and 8, the front contacts 12 are arranged in two rows to facilitate the configuration of the PCB 16, specifically to enable a sufficient distance to be provided between the location holes in the PCB 16. To take account of this, the support regions 12A of the contacts in the upper row (contacts "1", "3", "5" and "7") include a deflection 12C that descends towards the plane of the contacts in the lower row. In the particular arrangement shown, the deflection regions 12C do not all have the same shape but this is not significant for the purposes of the present invention. In the event of it being possible to arrange the contacts in one row, the deflection regions can be omitted.

All of the contacts of the second type (contacts "1", "2", "4" and "6") then bend backwards at points 12D, all of which are located at a specified distance from the PCB 16, to form an angle of about 45° between the support region 12A and the contact region 12B of each contact. The contacts of the first type (contacts "3", "5", "7" and "8"), on the other hand, turn generally upwards before bending downwards at points 12E (all located at substantially the same distance from the PCB 16) to form an angle of about 45° in the opposite direction between the support region 12A and the contact region 12B of each contact. In this case, there is a slight difference between the contacts, "7", "8" and the contacts "3", "5" as regards the upward turn in going from the support region 12A to the contact region 12B, this difference being incorporated to bring about a further reduction in crosstalk. More specifically, in each of the contacts "7", "8", there is an intermediate portion 12F between the support and contact regions 12A, 12B that extends upwards substantially perpendicular to the generally forward-extending direction of the contact (i.e. the intermediate portion 12F is substantially vertical) whereas, in the contacts "3" and "5", the corresponding intermediate portion 12G extends upwards at a slight inclination to the perpendicular.

The contacts of a plug inserted into the jack 10 will engage the front contacts "3", "5", "7" and "8" at the top of their contact regions 12B (i.e. at the apex of the bend points 12E) and the front contacts "1", "2", "4" and "6" at substantially adjacent locations on their contact regions 12B, exerting a downward force on all of the front contacts (as viewed in the drawings). Initially, both types of front contact 12 are supported only in the support region 12A by the PCB 16 and the locking member 21. Downward pressure on the bend points 12E of the contacts "3", "5", "7" and "8" will cause the contacts to bend until their free ends 13 engage a stop surface 40 in the base 18 of the front housing part 22 of the jack 10. Thereafter, those contacts "3", "5", "7" and "8" will be supported at both ends during continued downward pressure from the inserted plug. In the case of the other contacts "1", "2", "4" and "6", the downward pressure from the inserted plug is exerted on the contact regions 12B and will move the free ends 13 of those contacts into engagement with a stop surface 41 on the contact support 14. Thereafter, continued downward pressure from the inserted plug will move the support regions 12A of those contacts, adjacent the bends 12D, into engagement with a stop surface 42 on the locking member 21. If the inserted plug is removed from the jack 10, the front contacts 12 will return to their original positions.

It will be appreciated that the two contact types in the array shown in FIGS. 7 and 8 could, if desired, be interchanged.

The shaping of the first type of contacts "3", "5", "7" and "8" in the array of FIGS. 7 and 8 can provide those contacts with certain advantageous mechanical properties (described in more detail below) and, in situations in which those mechanical properties are more important to the user than a reduction in crosstalk, a jack can be provided in which all of the contacts have that general shape. This could be appropriate, for example, when there is less need to increase the density of connectors in a particular location by spacing the front contacts of the jacks as closely together as possible and, as a result, crosstalk is less of a problem, or where crosstalk will be compensated in other stages of the connector.

A contact array of that type will now be described with reference to FIGS. 9 and 10. The flexible spring contacts 112 of this array are alternately substantially similar to the contacts "7" and "8" of FIGS. 7 and 8, and corresponding components carry the same reference as in FIGS. 7 and 8 but with the prefix "1" (i.e. increased by 100). As described above, and shown in FIGS. 9 and 10, each of the contacts 112 comprises a support region 112A adjacent the end of the contact that is mounted in the PCB (not shown) of the jack, and a contact region 112B adjacent the other (free) end of the contact. The general direction of extent of the contact 112 is towards the front of the jack 110 although, as described above for the contacts "7" and "8" of FIGS. 7 and 8, the contact region 112B is joined to the support region 112A by an intermediate portion 112F that extends upwards substantially perpendicular to the generally forward extending direction (i.e. the intermediate portion 112F is substantially vertical as seen in FIGS. 15 and 16). The contact region 112B then extends downwards at an angle of approximately 45° from the intermediate portion 112F.

Figure 9:
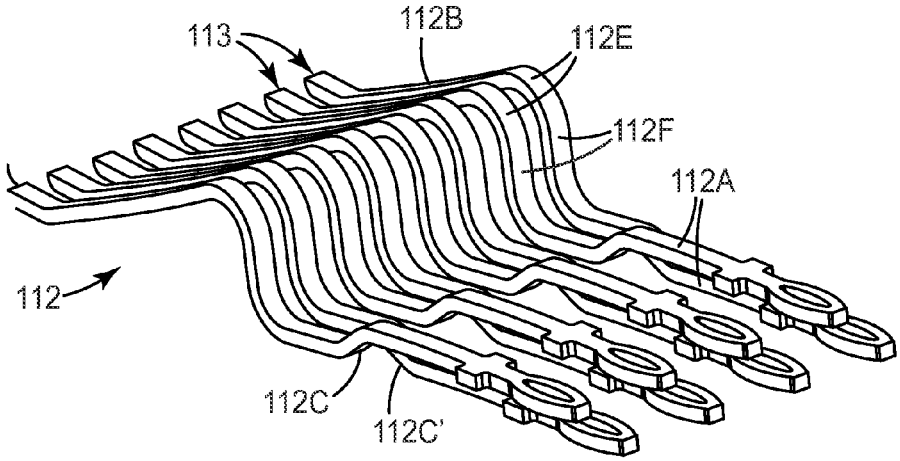
FIGS. 9 and 10 are views similar, respectively, to those of FIGS. 7 and 8 but show an alternative array of front contacts.
Figure 10:
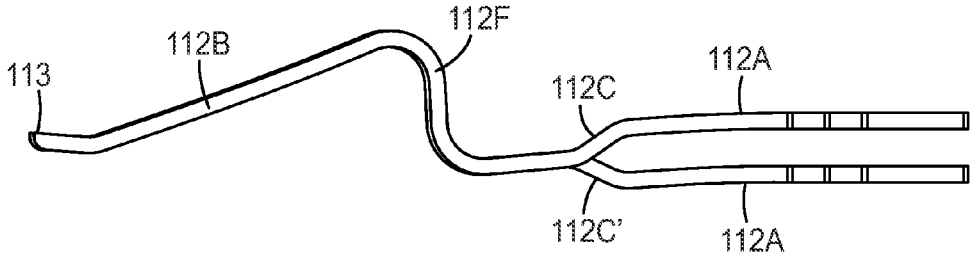

The contact array of FIGS. 9 and 10 could replace the array of FIGS. 7 and 8 in the jack of FIGS. 2 to 4. As described above with reference to FIGS. 7 and 8, the apex of the bend 112E is the point in each of the contacts 112 that will be engaged by a mating plug inserted into the jack 110. As can be seen from FIG. 10, the contacts 112 of the jack 110 are arranged so that the points 112E are substantially aligned and, consequently, will all be engaged substantially simultaneously by the mating plug.

FIGS. 9 and 10 show that the contacts 112, like those of the jack 10, are arranged in two rows to facilitate the configuration of the PCB (not shown) in which the contacts are mounted. To accommodate this, the support region 112A of each contact in the upper row comprises a downward deflection 112C, and the support region 112A of each contact in the lower row comprises an upward deflection 112C' to bring the contact regions 112B of the contacts into alignment. It has been found that, despite these differences in shape, the behaviour of the contacts in the two rows is similar due to the presence of the intermediate portion 112F in each contact.

Figure 11:
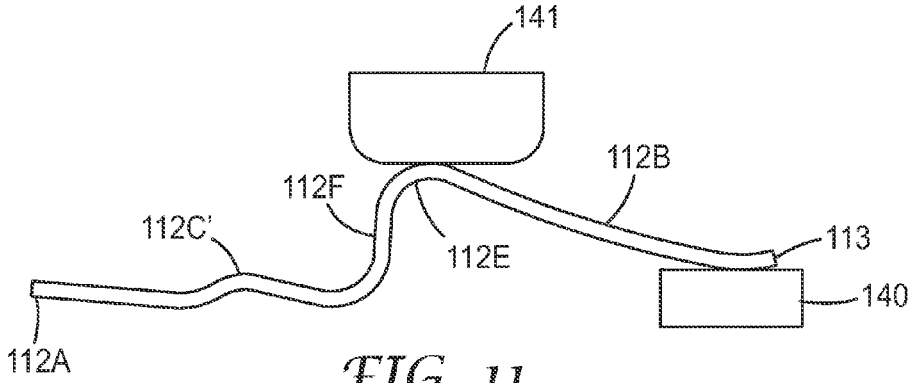
FIG. 11 is a diagrammatic side view of one of the contacts from FIG. 10, in the reverse orientation, illustrating the effect of the contact being engaged by a plug inserted into the jack.

The advantageous mechanical behaviour of the contacts 112, when engaged by a mating plug inserted into the jack in which they are mounted, will now be described with reference to FIG. 11 which shows a side view of one of the contacts of the lower row of the array of FIGS. 9 and 10. In FIG. 11, the reference 140 indicates a support surface for the free end 113 of the contact, provided (as described above with reference to FIGS. 7 and 8) by an internal surface of the jack, and the reference 141 indicates a contact of a mating plug inserted into the jack. The engagement of the plug contact 141 with the points 112E of the jack contact 112 exerts a downward pressure (as seen in FIG. 11) on the jack contact causing it to flex downwards until the plug is removed whereupon the contact will return to its original position. The contact force between the jack contact 112 and the plug contact 141 is enhanced due to the presence of the stop 40 in combination with the support for the other end of the contact 112 provided by the PCB 16 and the locking member 21 and this, in turn, enhances the electrical performance of the connection. Moreover, provided the inserted plug engages the points 112E of the contacts 112, the enhanced contact force will be achieved regardless of variations in the dimensions of the plug in the direction perpendicular to that in which it is inserted into the jack.

A similar advantageous effect can be achieved using contacts substantially similar to the contacts "3" and "5" of FIGS. 7 and 8.

It will be appreciated that the particular construction of the jack 10 can be modified if required. Alternative jack constructions are described, for example, in WO 2007/021684 (3M Innovative Properties Company); U.S. Pat. No. 5,957,720 (Boudin); US 2002/0132532 (Henneberger); and U.S. Pat. No. 6,120,330 (Gwiazdowski).

The invention claimed is:

1. A telecommunications connector having a jack form, comprising:

an array of eight contacts connectable to telecommunications wire pairs, comprising:

a first contact and a second contact of a first contact type and forming a first contact pair connectable to a first telecommunications wire pair;

a seventh contact and an eighth contact of a second contact type and forming a second contact pair connectable to a second telecommunications wire pair;

an inner zone comprising a third contact, a fourth contact, a fifth contact, and a sixth contact, the inner zone of contacts disposed between the first and second contact pairs, wherein the third and sixth contact are connectable to a third telecommunications wire pair and the fourth and fifth contact are connectable to a fourth telecommunications wire pair, wherein each type comprises a support region by which the contact is mounted in the connector and a contact region positioned to make electrical connection with a respective contact of a mating telecommunications connector; wherein, to introduce crosstalk compensation:

(i) the first type of contact is shaped so that its contact region extends in a first direction and the second type of contact is shaped so that its contact region extends in an opposing direction to the first direction;

(ii) adjacent contacts of the first zone of the array are alternately of the first and second types; and (iii) the inner zone contact adjacent the first contact pair is of the second contact type, and the inner zone contact adjacent the second contact pair is of the first contact type, and wherein the second type of contact is shaped so that engagement of the contact region by a respective electrical contact of the mating telecommunications connector moves a free end of the contact into engagement with a stop to enhance the electrical connection between the telecommunications connectors.

2. A connector as claimed in claim 1, in which the support region of each contact is joined to the contact region through at least one bend in the contact.

3. A connector as claimed in claim 1, in which at least one of the contacts has a deflection in the support region.

4. A connector as claimed in claim 1, in which the contacts are flexible, resilient contacts.

5. The combination of a connector as claimed in claim 1 in the form of a jack, and a mating plug.

6. A connector as claimed in claim 1, in which the support regions of the contacts are located in a printed circuit board and are connected to respective electrically-conductive traces on the board.

7. A connector as claimed in claim 6, in which the electrically-conductive traces connect the contacts to respective insulation displacement contacts connectable to respective wires of telecommunications wire pairs.

8. A connector as claimed in claim 1, in which the contact region of the first type of contact extends generally in the same direction as the support region of the contact, and the contact region of the second type of contact extends generally in the opposite direction to the support region of the contact.

9. A connector as claimed in claim 8, in which the support and contact regions of the first type of contact extend generally towards the direction from which a mating connector is introduced.

10. A connector as claimed in claim 9, in which at least one of the contacts of the first type comprises an intermediate portion, between the support and contact regions, that extends substantially perpendicular to the generally direction of extent of the contact.

11. A connector as claimed in claim 1, in which at least one of the contacts has a contact region that is joined to the support region by an intermediate portion that extends in a direction generally perpendicular to the direction of extent of the support and contact regions;

the contact being so shaped that engagement of the contact region by a respective electrical contact of the mating telecommunications connector moves the free end of the contact into engagement with a stop to enhance the electrical connection between the telecommunications connectors.

12. A connector as claimed in claim 11, in which at least one of the contacts has a deflection in the support region.

13. A connector as claimed in claim 11, in which contact region is joined to the intermediate portion through a bend in the contact region.

14. A connector as claimed in claim 13, in which the said bend in the contact region of each contact is engageable by a respective electrical contact of the mating telecommunications connector.

* * * * *